United States Patent [19]

Cotton et al.

[11] Patent Number: 4,663,538

[45] Date of Patent: May 5, 1987

[54] CONTROL FOR COIN ACTUATED APPLIANCES

[75] Inventors: Curran D. Cotton; David I. Ellingson; Donald E. Erickson; William J. Noe; James D. Wilson, all of Newton, Iowa

[73] Assignee: The Maytag Company, Newton, Iowa

[21] Appl. No.: 819,208

[22] Filed: Jan. 15, 1986

[51] Int. Cl.[4] ..... G07F 13/00

[52] U.S. Cl. ..... 307/38; 307/116; 307/113; 194/217; 194/211; 68/12 R; 68/20

[58] Field of Search ..... 307/38, 139, 113, 116; 194/350, 241, 239, 217, 211, 215, 216; 68/4, 3 R, 12 R, 14, 19.2, 20, 23.7, 26; 200/DIG. 3, 27 B; 364/145, 146

[56] References Cited

U.S. PATENT DOCUMENTS

| | | | |
|---|---|---|---|
| 3,076,107 | 1/1963 | Johnston | 68/12 R X |
| 3,110,384 | 11/1963 | Rub | 194/217 |
| 3,531,791 | 9/1970 | Wells | 68/12 R X |
| 3,632,988 | 1/1972 | Yamawaki | 194/211 X |
| 3,731,777 | 5/1973 | Burke et al. | 194/217 |
| 4,335,591 | 6/1982 | Gillespie | 68/12 R |
| 4,390,965 | 6/1983 | Albert | 364/145 X |
| 4,418,398 | 11/1983 | Hornung | 364/146 X |
| 4,507,942 | 4/1985 | Hirose et al. | 68/20 |
| 4,510,778 | 4/1985 | Cotton | 68/12 R |
| 4,555,639 | 11/1985 | Melek | 307/38 |

OTHER PUBLICATIONS

American Dryer Corporation, American Computer Drying System, Phase II.

Cissell Manufacturing Company, Dimension 2000 Coin Operated Dryer.

Speed Queen Company, Speed Queen Computerized Dryer.

*Primary Examiner*—William M. Shoop, Jr.

*Assistant Examiner*—Shik Luen Paul Ip

*Attorney, Agent, or Firm*—Richard L. Ward

[57] ABSTRACT

A control system is provided for controlling the operation of at least a pair of coin actuated appliances. A control panel area is provided which includes a coin drop mechanism, selection switches and indicators. A microcontroller is in circuit association with the coin drop mechanism, the selection switches and the indicators. The microcontroller is operable for accumulating the value of coins received and for effecting a display of the value in the indicators. Upon operation of a selection switch for a particular appliance by the appliance user, the microcontroller will effect operation of that appliance and the assignment of the displayed value to that appliance.

16 Claims, 6 Drawing Figures

| | | |
|---|---|---|
| Fig. 3A | Fig. 3B | Fig. 3C |

CONTROL FOR COIN ACTUATED APPLIANCES

BACKGROUND OF THE INVENTION

This invention relates generally to the field of controls for coin actuated appliances and more particularly to utilizing a microcontroller with coin receiving apparatus for operating at least a pair of coin actuated appliances and wherein the microcontroller accumulates purchased time which may be transferred to a selected appliance by actuation of cycle selection means for that appliance.

The prior coin actuated control systems have included the use of a centralized coin operated mechanism for operating a plurality of commercial washing machines from a single location such as in U.S. Pat. No. 3,076,107 issued on Jan. 29, 1963 to Johnston. When a coin is inserted a washer may be actuated by pushing a switch button at the remote location for energizing a low voltage relay to close a set of contacts for energizing a high voltage solenoid to actuate the self-contained timer for a particular washing machine.

Prior coin actuated control systems for commercial fabric dryers have also included use of a microcontrollerbased control in combination with coin receiving apparatus but only for operating a single dryer.

Cotton, in U.S. Pat. No. 4,510,778, issued Apr. 16, 1985 and assigned to the assignee of the instant invention, discloses a control wherein a single microcontroller controls the operation of a plurality of associated appliances. The associated appliances are operable independently or concurrently. Cotton does not provide for time accumulation and transfer of accumulated time to a selected appliance.

There have thus been shown systems directed to a centralized single coin mechanism for operating a plurality of commercial appliances, to the use of a microcontroller-based system for controlling operation of individual commercial fabric dryers, and to a control system wherein a single microcontroller is utilized for controlling operation of a plurality of associated appliances either independently or concurrently. There has been no known showing, however, of a control for coin actuated appliances wherein a microcontroller is used in conjunction with a coin receiver to accumulate or total the time value of coins inserted and with subsequent assignment of that time value to a selected appliance.

SUMMARY OF THE INVENTION

It is therefore an object of thee instant invention to provide an improved control for coin actuated appliances.

It is a further object of the instant invention to provide a coin actuated appliance control operable for accumulating purchased time and transferring the accumulated time to a selected one of a plurality of appliances.

It is a still further object of the instant invention to provide a control where a single microcontroller in combination with a single coin receiving apparatus operates a plurality of coin actuated appliances.

Briefly, the instant invention achieves these objects in a coin-actuated control system for controlling the operation of at least a pair of associated appliances. A power supply provides electrical power to the control system and to each of the appliances. A control panel is associated with the appliances and includes selection switches for inputting cycle selection information for each of the appliances and indicators for displaying cycle selection and operating information. A microcontroller is in circuit communication with the selection switches, the indicators and the power supply and is operable for controlling each of the appliances through selected cycles of operation independently of each other. Coin receiving apparatus receives coins and includes coin sensing circuitry in circuit association with the microcontroller for validating the coins received. The microcontroller is operable for totaling the value of coins received and for effecting a display of that value in the indicators. An actuator member is operable for assigning the displayed value to one of the appliances and for conditioning the one appliance for energization.

Operation of the control system and further objects and advantages thereof will become evident as the description proceeds and from an examination of the accompanying five sheets of drawings.

BRIEF DESCRIPTION OF THE DRAWINGS

The drawings illustrate a preferred embodiment of the invention with similar numerals referring to similar parts throughout the several views, wherein:

FIGS. 3A–3C together provide an electrical schematic drawing of the control for the coin actuated commercial fabric dryers of FIG. 1.

DESCRIPTION OF A PREFERRED EMBODIMENT

Figure 1:
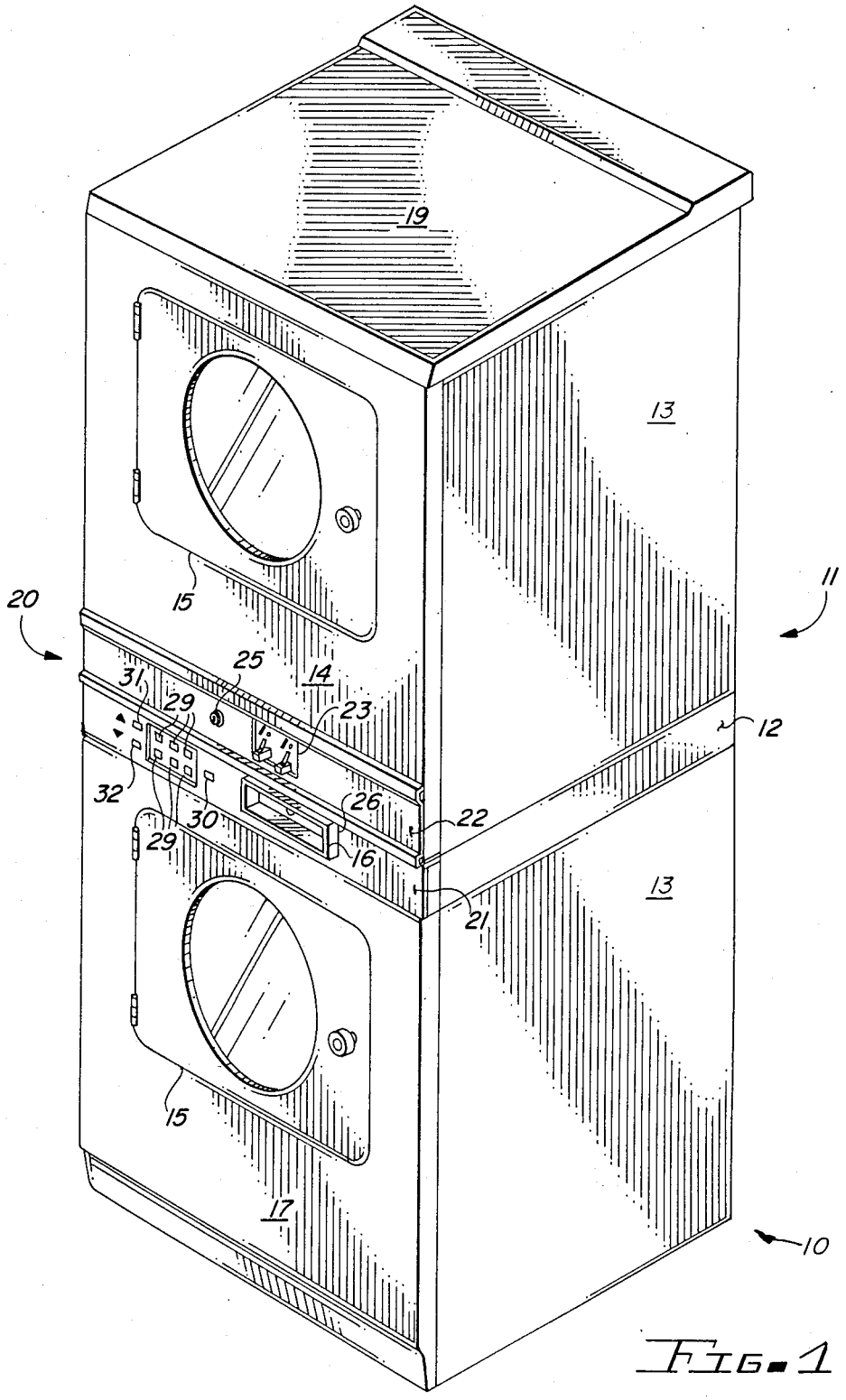
FIG. 1 is an isometric view of a stacked pair of coin actuated commercial fabric dryers utilizing the control of the instant invention.

Turning now to the drawings, there is best shown in FIG. 1 a pair of commercial fabric dryers 10 and 11 mounted one on top of the other in a stacked arrangement through an intermediate spacer or support assembly 12. While the preferred embodiment of the instant invention illustrates a control for a pair of fabric dryers 10 and 11, it is envisioned that the control could be utilized with other commercial combinations such as a washer and dryer, a pair of washers or more than a pair of appliances.

In this embodiment of the invention, each fabric dryer 10 or 11 is housed within a generally rectangular housing formed by a wrap-around cabinet having vertical side panels 13 and removable vertically oriented front panels 14 and 17. The vertically oriented front panels 14 and 17 include hinged access doors 15 for loading and unloading fabrics to be dried.

Located on top of the lower fabric dryer 10 for receiving and supporting the upper fabric dryer 11 is the previously mentioned intermediate spacer or support assembly 12. The intermediate spacer or support assembly 12 is a weldment formed from heavy gauge sheet metal which mounts the coin vault 16 as best shown in FIG. 1. The coin vault 16 is protected from vandalism by the spacer or intermediate support assembly 12 sandwiched between the upper and lower fabric dryers 10 and 11. As also shown in FIG. 1, the top of the upper dryer 11 is enclosed by a top cover arrangement 19.

Figures 2, 3:
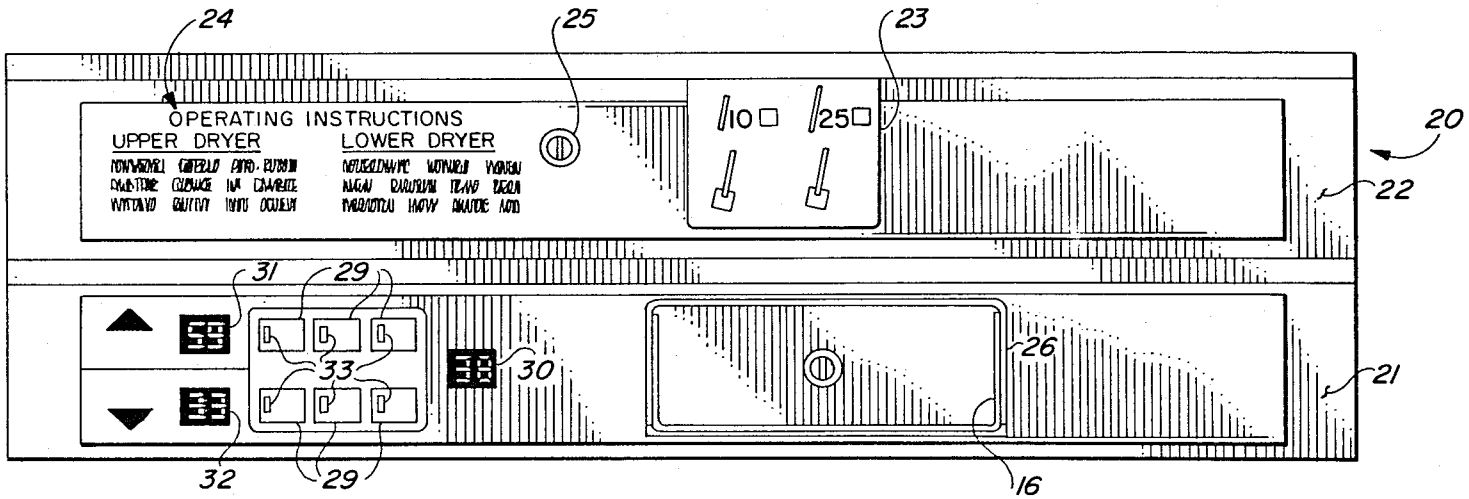
FIG. 2 is an enlarged view of the control panel for the stacked pair of commercial fabric dryers shown in FIG. 1.
FIG. 3 depicts how

As further shown in FIG. 1, the control panel 20 for the pair of stacked commercial fabric dryers 10 and 11 is formed from a pair of extrusions 21 and 22. These extrusions 21 and 22 are attached to the intermediate spacer or support assembly 12 and to the lower portion of the front panel 14 of the upper fabric dryer 11 respectively. The physical layout of the control panel 20 is best shown in FIG. 2. The upper portion of the control panel 20 includes a single coin receiving assembly in the form of a double coin drop 23 for receiving coins of ten and twenty-five cent denominations in this particular embodiment. In the instant invention, the term "coin" is intended to include, in addition to the ten and twenty-five cent U.S. denominations, other common U.S. coin and paper denominations. Also, the term "coin" is intended to include foreign coins and miscellaneous tokens and checks which may be used in place of money.

Included in the upper portions of the control panel 20 are the operating instructions 24 and a key actuated switch 25 which will be further discussed herein. The lower portion of the control panel 20 contains an opening 26 through which a collar portion of the previously discussed coin vault 16 extends. The left side of the lower portion of the control panel 20 includes a touch actuated array of six membrane switches 29 and three two-digit displays 30, 31 and 32. The internal spacer or support assembly 12 actually physically mounts the control printed circuit board 34 including the membrane switches 29 and the three two-digit displays 30, 31 and 32 behind the lower portion of the control panel 20.

The upper horizontal row of three membrane switches 29 contains the cycle selection information for the upper fabric dryer 11. Located alongside of each membrane switch 29 is an LED 33 for indicating which cycle selection has been made. Reading from left to right, the membrane switches 29 are labeled "Whites and Colors", "Permanent Press", and "Delicate". The lower horizontal row of membrane switches 29 includes the same cycle information for the lower fabric dryer 10. The two-digit display 30 located on the right side of the membrane switches 29 is labeled "Time Purchased" and the other two-digit displays 31 and 32 located on the left side of the membrane switches 29 are labeled "Drying Time Upper Dryer" and "Drying Time Lower Dryer" respectively.

Figure 3A:
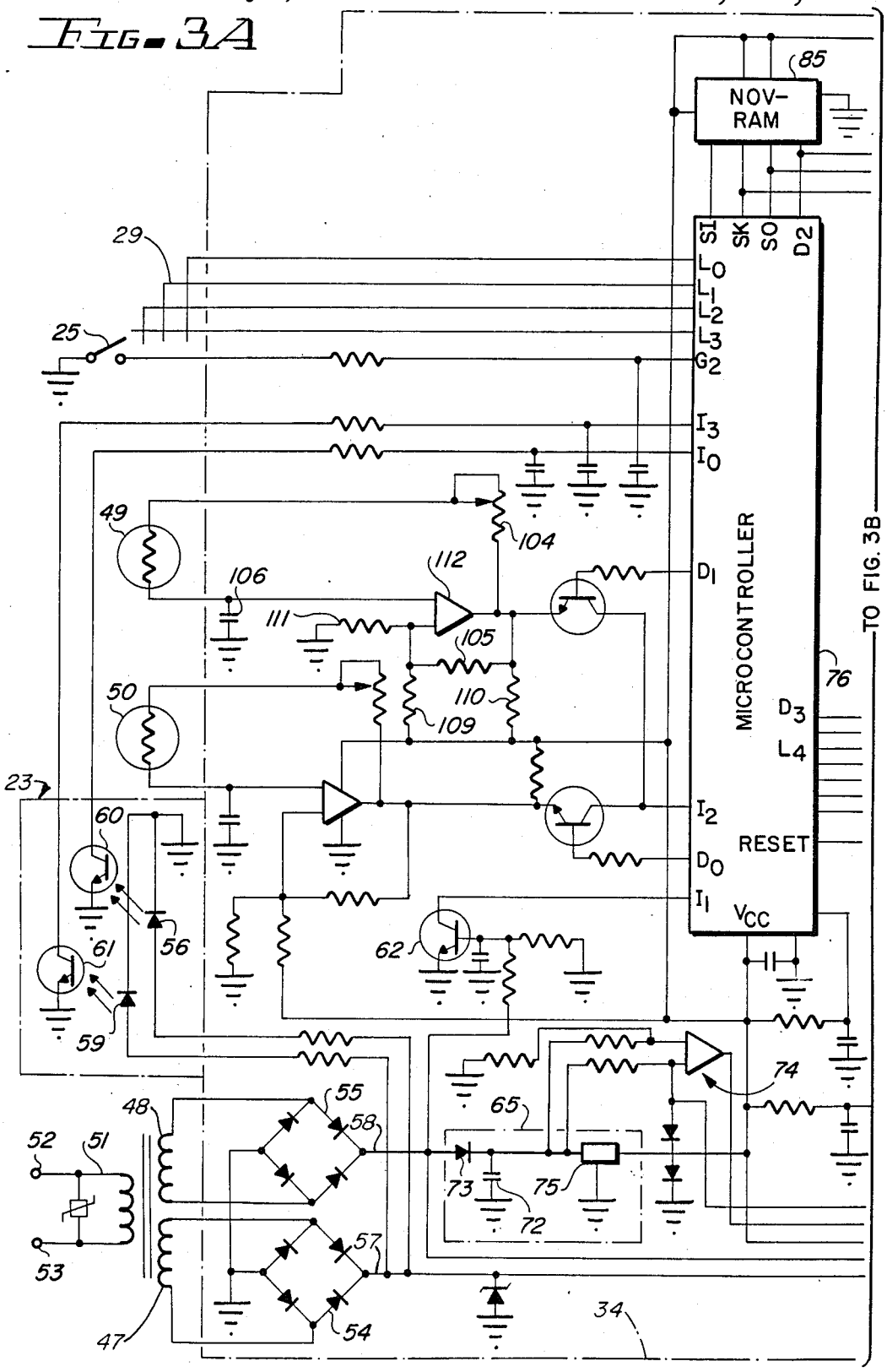
FIGS. 3A, 3B and 3C are joined.
Figure 3B:
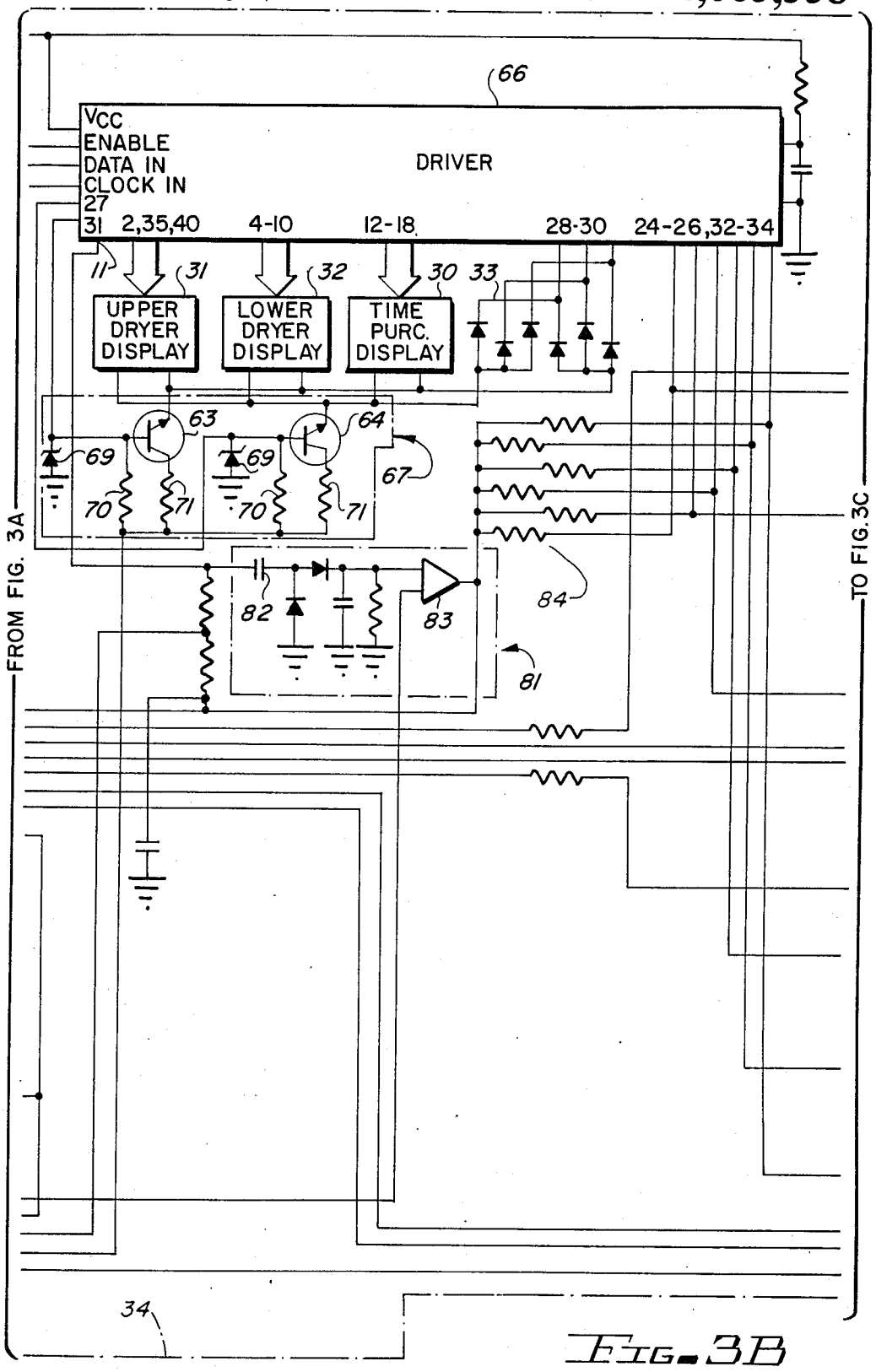
Figure 3C:
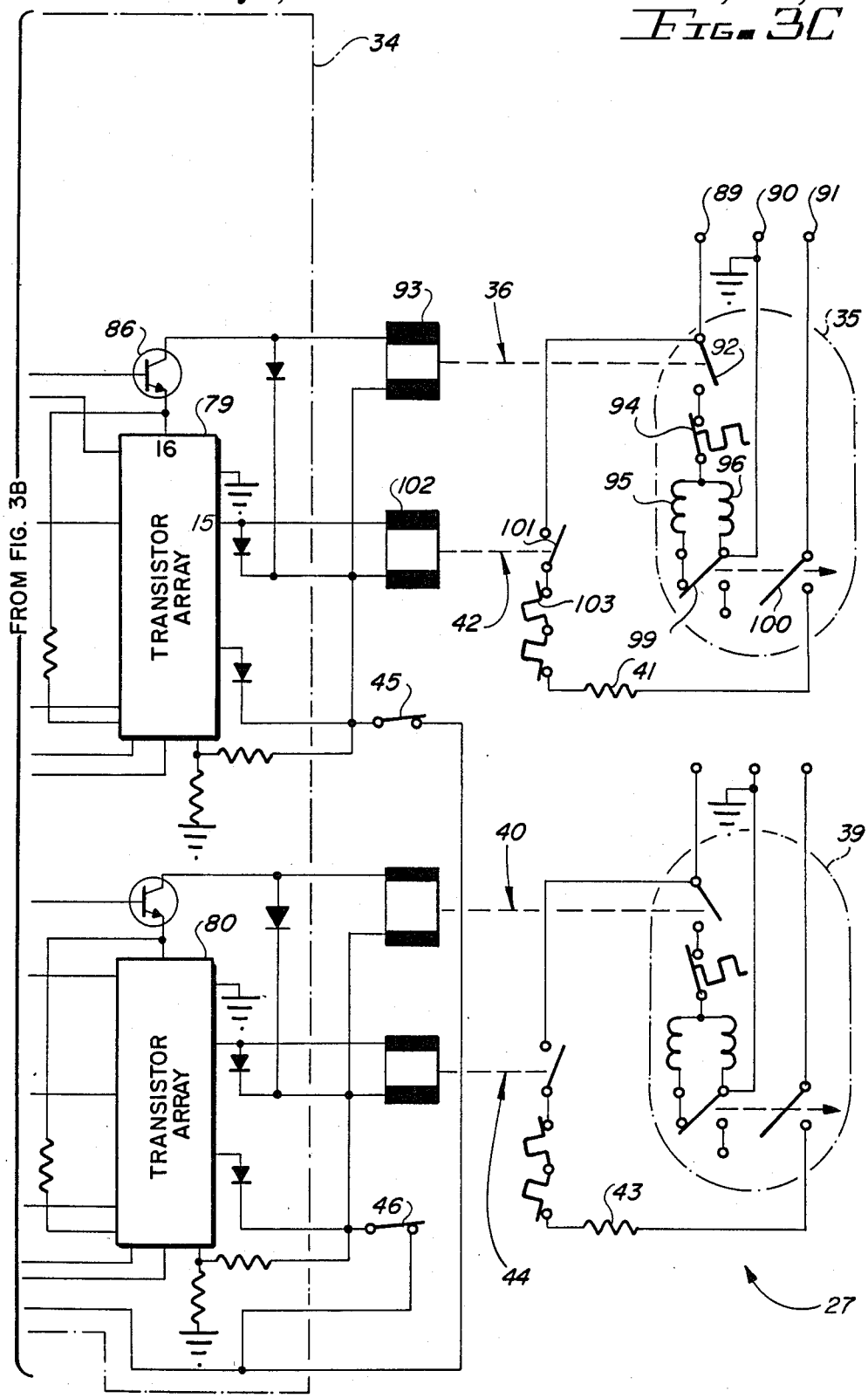

Referring now to FIGS. 3A–3C, there is shown an electrical control circuit 27 for the pair of coin actuated fabric dryers 10 and 11 of FIG. 1. The majority of the circuit 27 shown in FIGS. 3A–3C is located on a printed circuit board 34 generally outlined by phantom lines in FIGS. 3A–3C. Several components are electrically associated with the printed circuit board 34 but are not physically mounted thereon. These off-board components are the upper fabric dryer drive motor 35 and its relay 36, the lower fabric dryer drive motor 39 and its relay 40, upper and lower heaters 41 and 43 and their relays 42 and 44, upper and lower door switches 45 and 46, upper and lower dryer thermistors 49 and 50, the coin drop 23, transformer 51, membrane switches 29, and the key actuated switch 25. These off-board components are shown outside the phantom line perimeter of the circuit board 34.

As shown in FIG. 3A, the transformer 51, located away from but electrically connected to the circuit board 34, is powered by 120 VAC across conductors 52 and 53 supplying power to the control circuit 27 for the fabric dryers 10 and 11. The transformer 51 supplies 26.4 VAC at secondary coil 47 and 10 VAC at secondary coil 48 to a pair of bridge rectifiers 54 and 55. The 26.4 VAC is rectified for providing DC voltage through conductor 57 to the door switches 45 and 46 and to the relay coils such as 93 and 102 through the door switches 45 and 46 as shown in FIG. 3C. This DC voltage is also supplied to the light emitting diodes 56 and 59 associated with the optoelectronic sensor transistor switches 60 and 61 of the coin drop 23.

The 10 VAC is rectified and provides a pulsating DC potential by means of conductor 58 to the base of transistor 62 whose purpose is the creation of a real time clock, to the 5 VDC power supply 65 and to transistors 63 and 64. The transistors 63 and 64 are part of a multiplexing package 67 shown in FIG. 3B.

As further shown in FIGS. 2 and 3B, visual interface at the control panel 20 is provided by the three two-digit displays 30–32 and the six LEDs 33. The displays 30–32 and LEDs 33 are enabled by a National Semiconductor MM5450 driver 66. The multiplexing package 67 consists of power transistors 63 and 64, two voltage reference zener diodes 69, two base bias resistors 70 and two power limiting resistors 71. Transistors 63 and 64 are alternately turned off and on (duplexed) at a rate of 60 Hertz according to the logic state of outputs "27" and "31" of the driver 66. The voltage wave shape supplied to transistor 62 creates a 120 hertz square wave pulse for timing the control of the pair of fabric dryers 10 and 11.

At the 5 VDC power supply 65 in FIG. 3A, capacitor 72 is charged to approximately 11 VDC through the blocking diode 73. This 11 VDC is then available to the low voltage detector circuit 74 and to the voltage regulator 75. The low voltage detector circuit 74 will provide a reset of the microcontroller 76 if the voltage input at the voltage regulator 75 is less than about 7 VDC. The voltage regulator 75 when supplied with an input voltage of greater than or equal to 7 VDC, provides 5 VDC (VCC) to operate the microcontroller 76 and related circuitry.

The microcontroller 76 shown in FIG. 3A is, in the preferred embodiment of the invention, a National Semiconductor COP 441 single chip N-channel microcontroller. The microcontroller 76 is adapted for serially outputting data on output "SO" to a "data in" input on the driver 66. The microcontroller 76 also provides a synchronizing pulse at output "SK" to move data on the "SO" output into the "data in" input of the driver 66.

As previously discussed, the driver 66, shown in FIG. 3B, is operable for driving or enabling the three two-digit displays 30–32 and the six LEDs 33 through outputs "2, 35–40, 4–10, 12–18, and 28–30". The driver 66 also outputs data on outputs 24–26 and 32–34 to a pair of transistor arrays 79 and 80 for driving the relays 36, 40, 42 and 44 associated with the upper and lower fabric dryers 10 and 11.

As best shown in FIG. 3A, input ports "L0–L3" of the microcontroller 76 are connected to the folded matrix of the membrane switch 29. These four input ports "L0–L3" produce six switches 29 which are decoded through the software for the appliances.

The missing pulse detector circuitry 81 of FIG. 3B monitors the transmission of data between the microcontroller 76 and the driver 66. If, for any reason, this transmission is interrupted, the transistor arrays 79 and 80 shown in FIG. 3C will be disabled. Output 11 of the driver 66 provides a 50 percent duty cycle square wave to charge capacitor 82 through associated circuitry. This action turns on amplifier 83 which supplies a pull-up voltage for resistors 84. Output "D3" of the microcontroller 76 serves to hold the missing pulse detector circuitry 81 low until the micrcontroller 76 outputs correct data upon initial power-up. If the low voltage detector circuit 74 detects a low voltage condition the "reset" output of the microcontroller 76 will be pulled low rendering the microcontroller 76 inactive. This inactivity will be sensed by the missing pulse detector circuitry 81 which will disable the transistor arrays 79 and 80.

As previously discussed, the control panel 20 of the stacked fabric dryers 10 and 11 includes provision for mounting a double coin drop mechanism 23. This coin drop mechanism 23 is purchased from Airpax Corporation and includes optoelectronic sensors having transistor switches 60 or 61 associated with each coin denomination for sensing inserted coins. As best shown in FIG. 3A, the transistor switches 60 or 61 of the optoelectronic sensors are in circuit with ports "IO" and "I3" of the microcontroller 76. The transistor switches 60 or 61 remain in a conductive state until an object such as a coin passes in front of the LED portions 56 or 59. When a coin passes in front of the LED portions 56 or 59, the transistor switches 60 or 61 cease to conduct and port "IO" or "I3" changes from a logic "0" to a logic "1" state. The microcontroller 76 is operable for accumulating a total of both the time value and monetary value of the quantity of money inserted into the coin drop mechanism 23 and for displaying the quantity of time purchased by that quantity of money but not yet assigned to a particular fabric dryer 10 or 11 in display 30. Use of the term "value" in the claims will mean either time value or monetary value since there is choice as to what might be displayed, for example. The microcontroller 76 will also keep a running total of the monetary value of all coins inserted into the coin drop mechanism 23 since the control was last reset by a service person. Thus, the owner will always know how much money there should be in the coin vault 16.

If, for any reason, power is interrupted to the microcontroller 76, the microcontroller 76 will send pertinent data from its memory to an Xicor X2443P novram 85 through output "SO". When power is restored the microcontroller 76 will "read" this data back into its memory through port "SI".

Referring now to FIG. 3C and the drive motor circuits for the upper and lower fabric dryers 10 and 11, only the circuitry for the upper fabric dryer drive motor 35 will be discussed since the two circuits are identical though controlled separately for independent operation either singly or simultaneously. The relay transistor (within the transistor array 79) for the upper fabric dryer drive motor 35 is serially connected to the emitter of transistor 86 at output "16" of the transistor array 79. Both of these transistors must be capable of being toggled before operation of the upper fabric dryer 11 is permitted. The state of the relay transistor for the upper fabric dryer motor 35 and transistor 86 are sensed at input "L4" of the microcontroller 76.

The upper fabric dryer motor 35 is energized by 120 VAC between power conductors 89 and 90 and the heater 41 for the upper fabric dryer is energized by 240 VAC between power conductor 89 and 91. Once the switch 92 for the motor relay 36 has been closed by energization of the coil 93 through transistor 86, a circuit is completed from conductor 89 through the relay switch 92, through the thermal protector 94, through the start and run windings 95 and 96 and through the centrifugal switch 99 to conductor 90. When the upper fabric dryer motor 35 has achieved run speed, the pair of internal centrifugal switches 99 and 100 will each be operated allowing the motor run winding 96 to operate alone and allowing the heater 41 to be energized between conductors 89 and 91 if the switch 101 for the heater relay 42 has been closed by energization of the heater relay coil 102 through output "15" of the transistor array 79. Although the control circuitry shown in FIGS. 3A–3C is specific to electric fabric dryers 10 and 11 it is anticipated that the control circuitry can also apply to gas fired clothes dryers.

Further shown in FIG. 3A are thermistors 49 and 50 which are physically located in the upper and lower fabric dryers 11 and 10 respectively for sensing the temperature of the airflow through the fabric dryers 11 and 10. The thermistor 49 provides a continuous back-up sensing system for the 155° cycling thermostat 103 and continuous temperature sensing input to the microcontroller 76. Referring specifically to thermistor 49 for the upper fabric dryer 11, the thermistor 49 and the variable resistor 104 form a feed-back component to provide the negative oscillation for an oscillator circuit with variable resistor 104 being operable for adjusting the frequency of the circuit, especially during manufacture, to compensate for tolerances and various timing delays. Resistor 105 is a feed-back component for providing the positive oscillation for the oscillator circuit. Capacitor 106 and the resistance of thermistor 49 determine the frequency of oscillation. Resistors 109 and 110 provide a reference voltage from which the circuit can oscillate and resistor 111 pulls down the output voltage of the amplifier 112.

Microcontroller 76 monitors the frequency of the oscillator circuit which varies as the resistance of the thermistor 49 varies with changes in temperature. The microcontroller 76, through the thermistor 49, limits operation of the fabric dryer 11 to temperatures between approximately minus 32° F. and 175° F. If the oscillation frequency is higher than the frequency corresponding to the upper temperature limit, it is an indication that the fabric dryer 11 is operating at too high a temperature and that the thermistor 49 or the 155° F. cycling thermostat 103 have failed.

As shown schematically in FIG. 3A, the control includes a key actuated mode switch 25. This mode switch 25 may be manually closed or opened by the owner of the fabric dryers 10 or 11 by inserting a key into the key receiver and rotating the key (not shown). Closure of the mode switch 25 is monitored by port "G2" of the microcontroller 76. When the contacts of the mode switch 25 are closed, the control system is in the user mode for normal operation of fabric dryers 10 or 11. When the contacts of the mode switch 25 are open the control system is in the owner mode for a programming-interrogation operation. When in the user mode the control system is operable for receiving coins and for controlling various selected cycles of operation. When in the owner mode, the membrane switches 29 become operable for effecting a slow or fast slew, initiating a three-minute program, entering or advancing the control and resetting or deselecting operations in the setting of the control.

Referring again to FIG. 2, and assuming that the control system has been placed in the owner mode by opening switch 25, the membrane switches 29 and the displays 30–32 will be assigned different nomenclature corresponding specifically to the owner mode.

In particular, display 30 will now display a "primary prompt", display 31 will display "data" and display 32 will display "data" and a "secondary prompt". The membrane switches 29, beginning at the left in the top row, will become "fast slew", "three minute program" and "enter/advance". The bottom row of membrane switches 29 starting at the left will become "slow slew", "three minute program" and "reset/select/deselect".

When in the owner mode, the control system provides the operator with a plurality of selectable states for servicing the fabric dryers 10 or 11, for keeping a record of money collected, for setting the regular pricing and for setting special pricing by days of the week.

Upon entering the owner mode by opening switch 25, the control system will be in a service state. In the service state, all of the LEDs 33 and display segments 30–32 will be flashing or the display 30 will contain a "PF" and the LEDs 33 and displays 31 and 32 will flash. The "PF" in display 30 indicates that a power failure has occurred since the time of day clock was last set and that special pricing times will not be correct until the clock is reset. The service state also provides a check for any failed LEDs 33 or displays 30–32. Each successive state of the control system is obtained by pressing the "enter/advance" switch 29.

The "diagnose control" state, is indicated by a "DC" in display 30. This state provides a method of determining if the control is operating correctly. When in this state, a service person can operate either dryer 10 or 11 by pressing the appropriate "3 minute program" switch 29. If the dryer 10 or 11 is off, a 3 minute permanent press program will be started. If the dryer 10 or 11 is operating any program that is running on that dryer 10 or 11 will be canceled. This state provides a service program with a means of checking operation of the dryer 10 or 11 without using coins.

The control is further operable in a "money counter" state by again touching the "enter/advance" switch 29. When this state is entered, displays 30–32 will contain the total amount of money collected since the money counter was last zeroed. The display 31 will contain one-hundreds of dollars, the display 32 will contain ones of dollars and display 30 will contain cents. The "money counter" state is zeroed or reset by pressing the "reset/-select/deselect" switch 29. When the displays 30–32 are zeroed or reset this state can be deselected with the "reset/select/deselect" switch 29 and the display 30 will display a "CC" representing counter canceled. Pressing the "reset/select/deselect" switch 29 again will select the "money counter" state and display all zeros.

Another owner programming state is the "regular B 25 cent pricing" state. When this state is entered the display 30 will contain the prompt "P", the display 32 will contain a 25, and the display 31 will flash the number of minutes presently being offered for 25 cents. The flashing indicates that display 31 may be changed by using either of the two slew switches 29. If the pricing information has been changed, the control will calculate the 10 cent pricing, rounded down, when this state is exited.

Also provided is a "regular 10 cent pricing" state. When this state is entered, the display 30 will contain a "P", the display 32 will show a 10, and the display 31 will flash the number of minutes presently being offered for 10 cents. If the 25 cent pricing was changed in the "regular 25 cent pricing" state, the 10 cent pricing was calculated and will not have to be adjusted unless it is in error.

In addition to the "regular 25 cent pricing" and "regular 10 cent pricing" states there are offered "special 25 cent pricing" and "special 10 cent pricing" states. In the "special 25 cent pricing" state the display 30 will show "SP", the display 32 will display "25" and display 31 will be flashing the number of minutes presently offered for twenty-five cents. the flashing data in display 31 can be changed by pressing either of the slew switches 29. If the "special 25 cent pricing" is changed the "special 10 cent pricing" will be calculated, rounded down, upon exiting this state. When in the "special 25 cent pricing" state there exists the capability of a free option which gives the user 10 more minutes of drying time each time a switch 29 is pressed and terminates the cycle if the door 15 is opened. To choose this option, select zero time for "special 25 cent pricing" and an "F" will be displayed in display 32. The times this option is in effect is controlled as in the "special pricing" state using the start and finish times and which will be discussed herein.

In the "special 10 cent pricing" state the display 30 will again show "SP", the display 32 will show "10" and display 31 will be flashing the number of minutes presently offered for ten cents. If the "special 25 cent pricing" was changed, the "special 10 cent pricing" was calculated and need not be changed unless it is unsatisfactory. The flashing display 31 indicates that it may be changed by using either of the slew switches 29.

The control further offers the owner the possibility of providing special prices for the user for a fixed interval of time during any combination of days of the week. The "special pricing" state is entered by again touching the "enter/advance" switch 29. The display 30 will show a "SP", the display 32 will show an "S" which is indicative of start, and display 31 will display numerals ranging from 00–23, as for hours of the day, which will be flashing and indicative of the present start time. The numerals in display 31 can be adjusted by pressing either of the slewing switches 29. The special pricing finish time is entered by again touching the "enter/advance" switch 29. The display 30 will still show "SP", the display 32 will show an "F" which is indicative of finish, and display 31 will show numerals ranging from 00–23 which will be flashing and indicative of the present finish time. Once again the finish time indicated by the flashing numeral in 31 can be adjusted with either of the slewing switches 29.

An additional owner programming state involves programming the time-of-day clock. When this state is entered by again touching the "enter/advance" switch 29, the display 30 will show a "CL", the display 32 will show the present minutes (00–59) and will be flashing, and display 31 will show the present hours (00–23). The minutes shown in display 32 may be adjusted by touching either of the slewing switches 29. The clock will stop until the time-of-day hours state is entered if the minutes were changed. This allows for accurate setting of the clock to a time standard. Pressing the "enter/advance" switch 29 will enter the state for setting the time-of-day hours. The display 30 will continue to show a "CL", the display 32 will show the present minutes (00–59), and display 31 will show the present hours (00–23) and will be flashing. The hours shown in display 31 may be adjusted by pressing either of the slewing switches 29.

A final owner programming state provides for selecting the day or days of the week for special pricing and setting of the day-of-week clock. When this state is entered, the display 30 will show a "d", the display 32 will show an "SP", and the display 31 will show the day of the week (1–7) and will be flashing. In this state of programming operation, the first day of the week must be defined. Then, based on this definition, the days that special pricing is desired are determined. Using either of the two slewing switches 29 the display 31 can be advanced. The "reset/select/deselect" switch 29 is then pressed to select or deselect special pricing. An "SP" in display 30 indicates that special pricing is selected for the day shown in display 31. Once all the special pricing days have been selected, display 31 is advanced to the present day of the week and the day or days of week for special pricing state is exited.

Assuming that the control system is in the user mode for normal operation of the fabric dryers 10 or 11, insertion of dime or quarter coins into the coin drop 23 by an appliance user will cause the microcontroller 76 to total both the time and monetary value of the coins received. The microcontroller 76 will also display in the time purchased display 30, a total of the time values assigned to the inserted coins but not yet assigned or designated to a particular fabric dryer 10 or 11. At any time, after the insertion of the first coin and subsequent display of the time purchased, the user can assign or designate the time purchased to either the lower or upper fabric dryer 10 or 11 and simultaneously initiate operation thereof by merely pressing the membrane switch 29 corresponding to the desired fabric setting for either the lower or upper fabric dryer 10 or 11. The microcontroller 76 will transfer the unassigned purchased time from the display 30 to the appropriate display 32 or 31 for the lower or upper fabric dryer 10 or 11. To purchase additional drying time, the user merely inserts more coins into the coin drop 23 and presses the membrane switch 29 corresponding to the desired fabric setting for the fabric dryer 10 or 11 being used. If both fabric dryers 10 and 11 are to be used concurrently, unassigned purchased time can be assigned or designated to the other fabric dryer 10 or 11 which is not in operation.

There has thus been described a control for use with at least a pair of coin actuated appliances. In the disclosed emodiment of this control, a single microcontroller is operable in conjunction with a single coin drop for providing an accumulating feature to total and display the time value of the coins received by the coin drop. The microcontroller is operable, upon actuation of one of a plurality of switches, for transferring or assigning the accumulated but undesignated operating time to the particular appliance associated with the actuated switch. The microcontroller is further operable for controlling operation of the coin actuated appliances either independently or concurrently. A key actuated mode switch is manually operable for switching the control between a user mode for normal operation of the fabric dryers and an owner mode for programming the control. The control described herein thus provides cost advantages for the operator of a commercial laundry. These cost savings are maximized in the embodiment using a single microcontroller in conjunction with a single coin drop to accumulate and subsequently assign purchased time to a selected one of a plurality of appliances controlled by the microcontroller.

In the drawings and specification, there has been set forth a preferred embodiment of the invention and although specific terms are employed, these are used in a generic and descriptive sense only and not for purposes of limitation. Changes in the form and proportion of parts as well as the substitution of equivalents are contemplated as circumstances may suggest or render expedient without departing from the spirit or scope of the invention as further defined in the following claims.

We claim:

1. A coin-actuated control system for controlling the operation of at least a pair of associated appliances, comprising: power supply means for providing electrical power to the control system and to each of said appliances; control panel means associated with said appliances and including selection means for inputting cycle selection information for each of said appliances, indicator means for indicating the cycle selected and display means comprising a first display for displaying the total value of coins received and at least second and third displays with one designated to each of said appliances for displaying operating information; control means including microcontroller means in circuit communication with said selection means, said indicator means, said display means and said power supply means and operable for controlling each of said appliances through selected cycles of operation independently of each other; coin receiving means for receiving coins and including coin sensing means in circuit association with said control means for validating the coins received, said control means operable for totaling the value of coins received and for effecting a display of that value in said first display; and means included in said selection means and operable for effecting the transfer of said displayed value from said first display to said second or third display designated to one of said appliances and for conditioning said one appliance for energization.

2. A coin-actuated control system as defined in claim 1 wherein said means operable includes switch means associated with said control panel means.

3. A coin-actuated control system for controlling the operation of at least a pair of associated appliances, comprising: power supply means for providing electrical power to the control system and to each of said appliances; control panel means associated with said appliances and including selection means operable in a first mode for inputting cycle selection information for each of said appliances and operable in a second programming-interrogation mode for altering operation of said control system, said control panel means further including indicator means for indicating the cycle selected and display means comprising a first display for displaying the total value of coins received and at least second and third displays with one designated to each of said appliances for displaying operating information; control means including a single microcontroller in communication with said selection means, said indicator means, said display means and said power supply means and operable for controlling each of said appliances through selected cycles of operation independently of each other; coin receiving means for receiving and validating coins, said control means operable for totaling the value of coins received and for effecting a display of the corresponding value in said first display; and means included in said selection means and operable for effecting the transfer of said displayed value from said first display to said second or third display designated to one of said appliances and for energizing said one appliance.

4. A coin-actuated control system as defined in claim 3 wherein said control panel means further includes manually operable lock means for controlling actuation of a switch to configure said selection means in either said first mode for cycle selection or in said second programming-interrogation mode.

5. A coin-actuated control system as defined in claim 4 wherein said lock means includes a keyed lock member for actuating said switch.

6. A coin-actuated control system as defined in claim 4 wherein said control means is cooperable with said selection means and display means when in said programming-interrogation mode for servicing said appliances, setting operating prices, setting special operating prices and keeping a record of money collected.

7. A coin-actuated control system as defined in claim 3 wherein said coin receiving means includes a single coin receiver for said associated appliances.

8. A coin-actuated control system for controlling the operation of at least a pair of associated appliances, comprising: power supply means for providing electrical power to the control system and to each of said appliances; control panel means associated with said appliances and including selection means for inputting cycle selection information for each of said appliances, indicator means for indicating the cycle selected and display means comprising a first display for displaying the total value of coins received and at least second and third displays with one designated to each of said appliances for displaying operating information; control means including microcontroller means in circuit communication with said selection means, said indicator means, said display means and said power supply means and operable for controlling each of said appliances through selected cycles of operation independently of each other; and a single coin receiver associated with said control panel means including coin sensing means in circuit association with said control means for receiving and validating coins, said microcontroller means operable for totaling the value of coins received and for effecting a display of the corresponding value in said first display, said selection means being selectively operable for effecting the transfer of said displayed value from said first display to said second or third display designated to one of said appliances and for energizing said one appliance.

9. A coin-actuated control system as defined in claim 8 wherein said control means includes a single microcontroller for controlling said pair of associated appliances.

10. A coin-actuated control system for controlling the operation of a pair of associated fabric dryers, comprising: power supply means for providing electrical power to the control system and to each of said fabric dryers; control panel means associated with said fabric dryers and including selection means operable in a first mode for inputting cycle selection information for each of said fabric dryers and operable in a second programming-interrogation mode for altering operation of said control system, said control panel means further including indicator means for indicating the cycle selected and display means comprising a first display for displaying the total value of coins received and second and third displays with one designated to each of said appliances for displaying operating information; control means including a single microcontroller in communication with said selection means, said indicator means, said display means and said power supply means and operable for controlling each of said fabric dryers through selected cycles of operation independently of each other; and a single coin receiver associated with said control panel means including coin sensing means in circuit association with said control means for receiving and validating coins of predetermined denominations, said control means operable for totaling the time and monetary value of coins received and for effecting a display of the corresponding accumulated purchased time value in said first display, said selection means being selectively operable for effecting the transfer of said displayed purchased time value from said first display to said second or third display designated to one of said fabric dryers and concomitant energization of said one fabric dryer associated with the operated selection means.

11. A coin-actuated appliance as defined in claim 10 wherein said control panel means further includes switch means actuatable for configuring said selection means in one of said first or second modes of operation.

12. A coin-actuated appliance as defined in claim 11 wherein said control means is operable with said selection means and said display means when in said programming-interrogation mode for servicing said fabric dryers, setting normal and special operating prices and for keeping a record of money collected.

13. A method of operating a pair of coin-actuated appliances having coin receiving means, indicator means, dispay means including first, second and third displays with one of said second or third displays designated to each of said appliances, selection means and microcontroller means for controlling said appliances, comprising the steps of: inserting coins into said coin receiving means; validating said inserted coins through coin sensing means; totaling the value of said coins inserted into said coin receiving means; accumulating purchased time corresponding to the value of said inserted coins; displaying the accumulated purchased time in said first display; assigning the displayed accumulated purchased time to said second or third display designated to one or the other of the pair of appliances; and conditioning that particular appliance for energization.

14. A coin-actuated control system for at least a pair of associated appliances, comprising: power supply means for electrically powering the control system and each of said appliances; display means including first, second and third displays with one of said second or third displays designated to each of said appliances; microcontroller means operable for controlling each of said appliances independently of each other; coin receiving means for receiving coins of first and second denominations and including coin sensing means in circuit with said microcontroller means for validating said coins; and selection means in circuit communication with said microcontroller means, said selection means being operable in a first user mode for inputting cycle selection and initiation information for each of said appliances to said microcontroller means and further operable in a second owner mode for effecting the programming of said microcontroller means with said display means operable for providing prompting information and displaying data when in said second owner mode, said microcontroller means being responsive to operation of said selection means in said first user mode for providing a programmed quantity of applicance operating time for each of said coin denominations and being reprogrammable through said selection means in said owner mode for providing a different quantity of appliance operating time for said first coin denomination with the quantity of appliance operating time for said second coin denomination automatically adjusted according to a preselected ratio.

15. A coin-actuated control system as defined in claim 14 wherein said selection means is further operable in said owner mode for overriding the automatic adjustment of operating time for said second coin denomination to provide for individual programming of that operating time.

16. A coin-actuated control system for at least a pair of associated appliances, comprising: power supply means for electrically powering the control system and each of said appliances; microcontroller means operable for controlling each of said appliances independently of each other; coin receiving means for receiving coins and including coin sensing means in circuit with said microcontroller means for validating said coins; selection means in circuit communication with said microcontroller means, said selection means operable in a first user mode for inputting cycle selection and initiation information for each of said appliance to said microcontroller means and further operable in a second owner mode for effecting the programming of said microcontroller means; and display means associated with said control panel means and including three two-digit displays, said two-digital displays operable in said first user mode for providing a read-out of cycle selection and operation information and further operable in said second owner mode for selectively providing a read-out of the total count of all coins received with a first two-digit display showing hundreds of dollars, a second two-digit display showing dollars and a third two-digit display showing cents.

* * * * *